US005431619A

United States Patent [19]

Bacon et al.

[11] Patent Number: 5,431,619

[45] Date of Patent: Jul. 11, 1995

[54] PROCESS AND APPARATUS FOR FORMING AN OUTWARDLY CURLED LIP ON CYLINDRICAL CONTAINER BODY

[75] Inventors: John E. Bacon; William C. Suski, both of Hartsville, S.C.

[73] Assignee: Sonoco Products Company, Hartsville, S.C.

[21] Appl. No.: 66,848

[22] Filed: May 25, 1993

[51] Int. Cl.[6] ..... B31D 5/00

[52] U.S. Cl. ..... 493/158; 493/159; 72/352

[58] Field of Search ..... 493/158, 159, 105, 106, 493/107, 108, 109; 413/1, 69, 70, 71; 72/352

[56] References Cited

U.S. PATENT DOCUMENTS

| | | | |
|---|---|---|---|
| 746,843 | 12/1903 | Jones | 493/109 |
| 2,802,407 | 8/1957 | Majer . | |
| 3,065,677 | 11/1962 | Loeser | 493/158 |
| 3,336,847 | 8/1967 | Durat . | |
| 3,343,465 | 9/1967 | Albert . | |
| 4,034,657 | 7/1977 | Boussageon . | |
| 4,238,949 | 12/1980 | Roper | 72/352 |
| 4,349,345 | 9/1982 | Bodendoerfer . | |
| 4,386,576 | 6/1983 | Johnson . | |
| 4,452,596 | 6/1984 | Clauss et al. . | |
| 4,490,130 | 12/1984 | Konzal et al. . | |
| 4,531,930 | 7/1985 | Clauss . | |
| 4,546,911 | 10/1985 | Clauss . | |
| 4,560,063 | 12/1985 | Müller . | |
| 4,571,233 | 2/1986 | Konzal . | |
| 4,596,620 | 6/1986 | Karolyi . | |
| 4,610,655 | 9/1986 | Müller . | |
| 4,667,844 | 5/1987 | Clauss . | |
| 4,680,016 | 7/1987 | Lynch . | |
| 5,135,462 | 8/1992 | Stahlecker et al. . | |

FOREIGN PATENT DOCUMENTS

| | | | |
|---|---|---|---|
| 0363845 | 12/1931 | United Kingdom | 72/352 |

*Primary Examiner*—Jack W. Lavinder

*Attorney, Agent, or Firm*—Bell, Seltzer, Park & Gibson

[57] ABSTRACT

The invention provides a process and apparatus for forming an outwardly rolled lip on a cylindrical container body. The apparatus of the invention includes a mandrel having a cylindrical shaped portion and a lip forming annular cavity positioned coaxially with, and axially spaced from the cylindrical portion of the mandrel. The annular cavity has a generally semi-circular cross-section including an open mouth and a closed bottom extending outwardly of the mandrel. The mandrel additionally includes a radially tapered portion between the cylindrical portion and the lip forming die. The radially tapered portion tapers radially outwardly in the direction towards the lip forming die. An axial forcing means forces a cylindrical container body axially along the mandrel towards the lip forming die to thereby stretch the open end before the end is forced into the cavity and rolled outwardly.

25 Claims, 4 Drawing Sheets

PROCESS AND APPARATUS FOR FORMING AN OUTWARDLY CURLED LIP ON CYLINDRICAL CONTAINER BODY

FIELD OF THE INVENTION

The invention is directed to a process and apparatus for forming an outwardly curled lip, i.e., rim, on a cylindrical container body. More specifically, the invention is directed to a process and apparatus for forming an outwardly curled or rolled lip on a cylindrical container body formed of a deformable material such as single or multiple layers of paperboard material.

BACKGROUND OF THE INVENTION

Non-metallic containers have achieved widespread commercial acceptance. These containers include a body made from plastic, paperboard, or a layered structure, such as one or more layers of paperboard having interior and/or exterior polymeric film or foil layers. Typically these container bodies are easier to manufacture, are less expensive, and/or are more environmentally acceptable than prior metal containers.

In cylindrical form, non-metallic containers include a separate closure member at one or both ends of the cylinder. In some instances, the closure member may be a metallic closure member which is joined to the container body by outwardly rolling a portion of the lip of the container into a metallic flange of the metal closure, which is then crimped into the container body structure. Alternatively a peelable lidding member can be attached directly to a container body by means of a thermal seal formed between an integral lip on the container body and the lidding member.

For plastic container bodies an integral top flange or lip can readily be formed during the molding process. However, for paperboard container bodies the lip-forming procedure is typically accomplished in a step separate from formation of the body, per se.

For relatively thin walled container bodies, such as convolutely wound, frustoconically shaped cup bodies or cup bodies formed of thin walled thermoplastic materials, it has been proposed to form a lip on the upper end employing an apparatus including a splined surface support member as disclosed in U.S. Pat. No. 4,680,016 to Lynch. The frustoconical container body is forced onto the frustoconical splined support and the open end is then forced axially into a semicircular annular groove which initially forms an outwardly folded rim. Thereafter, a tucking finger, mounted at a rimming station, rolls the outward fold into a rolled lip as the mandrel supporting the container body is rotated.

For relatively thick walled paperboard container bodies, for example, having a wall thickness greater than about 0.015 in., e.g. from 0.020 to 0.055 inch, rolled lips are more difficult to form. Conventionally, such rolled lips have been formed employing a metal can flanger of the type used to flange a metal can. This flanging apparatus has been used because of the high wall strength of thick walled paperboard container bodies. High wall strength is particularly apparent in spirally wound bodies formed of multiple layers of paperboard with and without inner and/or outer layers of film and/or foil materials. In addition to high wall strength, these spirally wound bodies have a true cylindrical shape and thus the walls of the open end are not flared outwardly adding to difficulty in forming a rolled lip.

The separate operation to form a rolled lip on relatively thick walled container bodies employing a separate flanging apparatus is both time consuming and requires added material handling procedures for passing partially formed container bodies to and from the flanging apparatus. Moreover, the use of the conventional flanging apparatus is a relatively slow process and the flanging apparatus is expensive.

SUMMARY OF THE INVENTION

The invention provides a simple and cost effective process and apparatus for forming a rolled or curled lip on a cylindrical container body. The process and apparatus of the invention can be used with thick walled paperboard, plastic, and composite layer body materials having wall thicknesses up to and exceeding 0.055 inches. The rolled lip forming process and apparatus of the invention can be readily incorporated into the conventional container body manufacturing process and apparatus so that a separate lip forming procedure using a separate apparatus is not required.

The apparatus of the invention for forming a rolled lip on a cylindrical container body includes a mandrel having a first cylindrically shaped portion for supporting a portion of the interior of a deformable cylindrical container body. A lip forming die having an annular cavity is positioned coaxially with, and is axially spaced from the cylindrical portion of the mandrel. The annular cavity has a generally semicircular cross-section including an open mouth and a closed bottom extending outwardly of the mandrel and is positioned with the open mouth oriented generally transverse to the axis to the mandrel and in a direction facing the cylindrically shaped portion of the mandrel. The mandrel additionally includes a radially tapered portion between the cylindrical portion of the mandrel and the lip forming die. The radially tapered portion of the mandrel tapers radially outwardly in the direction from the cylindrical portion of the mandrel towards the lip forming die. An axial forcing means forces the cylindrical container body axially along the mandrel for a sufficient distance to force one end of the container body along the outwardly tapering section of the mandrel and into the annular die cavity. Advantageously, the axially outwardly tapering portion of the mandrel is tapered in an amount of up to 20°, and preferably is tapered in an amount of from about 1° to about 10°.

In operation, a container body having an open end and about the same inside diameter has the outside diameter of the cylindrical portion of the mandrel, is placed onto the mandrel with the open end facing the lip forming die. The forcing member is thereafter engaged with the other end of the container body which can be either open or closed, to force the container body axially along the stationary mandrel in the direction towards the lip forming die. As the open end of the container body is forced over the outwardly radial tapering portion of the mandrel, the end portion of the container body is outwardly stretched. Thereafter, the stretched end of the container body is forced into the annular lip forming cavity. Continued axial pressure on the container body causes the end face of the container body to follow the semi-circular wall of the cavity and to roll outwardly, thereby forming the rolled lip on the container body.

Although not wishing to be bound by theory, it is believed that the outwardly radial tapering portion of the mandrel performs both a stretching and a deburring operation on the leading inside corner of the container body. In this regard, spirally wound container bodies are formed as a continuous tube on a stationary mandrel and container bodies are cut from the continuous tube employing a moving saw or blade which cuts radially through the bodywall of the continuous tube. This, in turn, results in an interior cylindrical burr on the end face of the tube. It is believed that this cylindrical burr interferes with the rolled lip forming process. In the present invention, the stretching operation is believed to eliminate or minimize the burr and/or to convert the burr into a form which more readily can be outwardly rolled as the end face of the cylindrical tube is forced into the lip forming annular die.

In one preferred embodiment of the invention, a turret-type forming apparatus which includes a plurality of radially oriented forming mandrels, incorporates the apparatus of the invention. Typically, the turret-type forming apparatus is also employed to form and attach a bottom closure on the end of the container body which is opposite the rolled lip end. By incorporating the apparatus of the invention into the turret-type forming apparatus, the lip forming operation can be conducted at any of various stations in the multi-station forming process. Preferably, the lip forming operation is accomplished in conjunction with an initial step of mounting a container body onto a mandrel.

BRIEF DESCRIPTION OF THE DRAWINGS

In the drawings which form a portion of the original disclosure of the invention.

DETAILED DESCRIPTION OF THE PREFERRED EMBODIMENT

Figure 1:
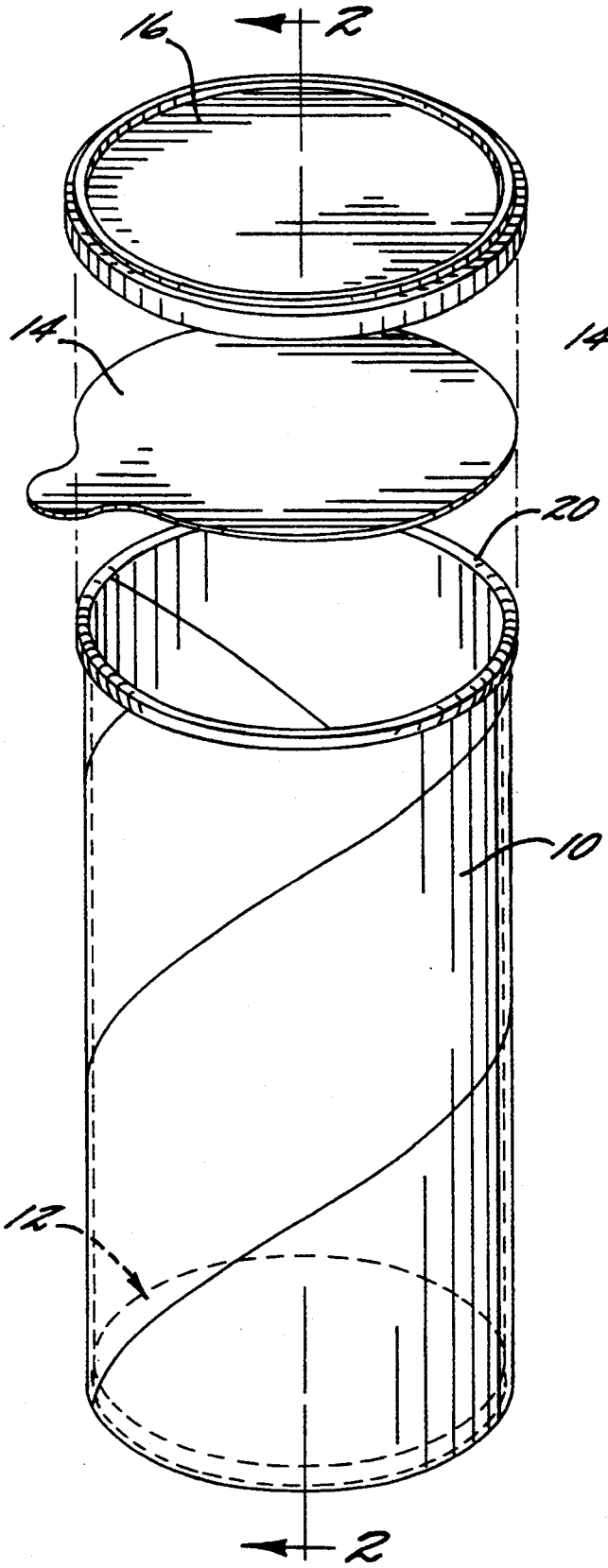
FIG. 1 is an exploded view of a container including a spirally wound container body having a rolled lip, a peelable lidding member for bonding to the rolled lip and a bottom closure formed into the other end of the container body.

FIG. 1 illustrates an exploded view of one preferred container which employs container bodies made according to the present invention. The container includes a spirally wound cylindrical bodywall 10, a separate bottom closure member 12, a peelable lidding member 14, and a deformable plastic lidding member 16 which can be used to reseal the package after removal of the peelable lidding member 14. The container body 10 is typically a thick walled composite or paperboard laminate having a thickness greater than about 0.020 inch. In the form illustrated in FIG. 1, the container bodywall 10 typically is formed from one or more paperboard layers and also includes an interior film or film/foil liner at location 18 shown in FIG. 2. The interior liner generally includes a polymeric coating on the interior-most surface thereof for thermal bonding to the interior of the peelable lidding member 14.

Figure 2:
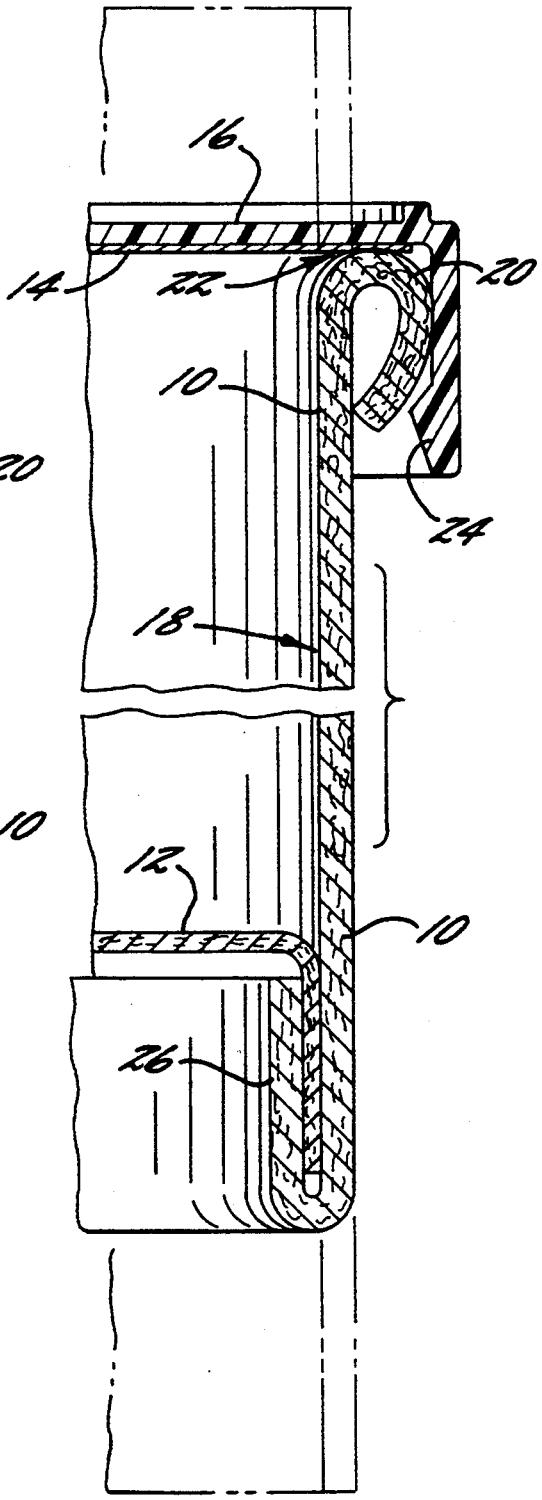
FIG. 2 is a cross sectional view taken generally along line 2—2 of FIG. 1 illustrating top and bottom portions of the container body in fully assembled form.

A rolled lip 20 is best seen in FIG. 2. The rolled lip provides a surface at location 22 for bonding to the peelable lidding member 14, and additionally provides an exterior flange for gripping by the flanged edge 24 of flexible closure member 16. As also best seen in FIG. 2, the bottom closure member 12 is trapped at a lower portion of the container body between an outer wall of the container body and an inwardly folded crimped edge 26.

The container body wall 10 is preferably formed by a conventional spiral winding process as will be well known to the skilled artisan. In general, such process involves wrapping one or more layers of continuous strip material around a stationary mandrel. Prior to winding of the layers, they are coated with adhesive materials to ensure formation of a strong bond within the bodywall. Generally, for container type structures, the interior-most layer is a film or film/foil laminate. To this layer is bonded one or more paperboard layers. The outer layer typically is a thin glossy paperboard layer and/or a film layer. The total bodywall thickness is normally between about 0.015 and about 0.070 inch, preferably between about 0.020 and about 0.055 inch. The continuous paperboard and film or foil strips are wound around the mandrel to thereby form a continuous cylindrical tube which is cut into segments of the desired length at the discharge end of the mandrel.

Figure 3:
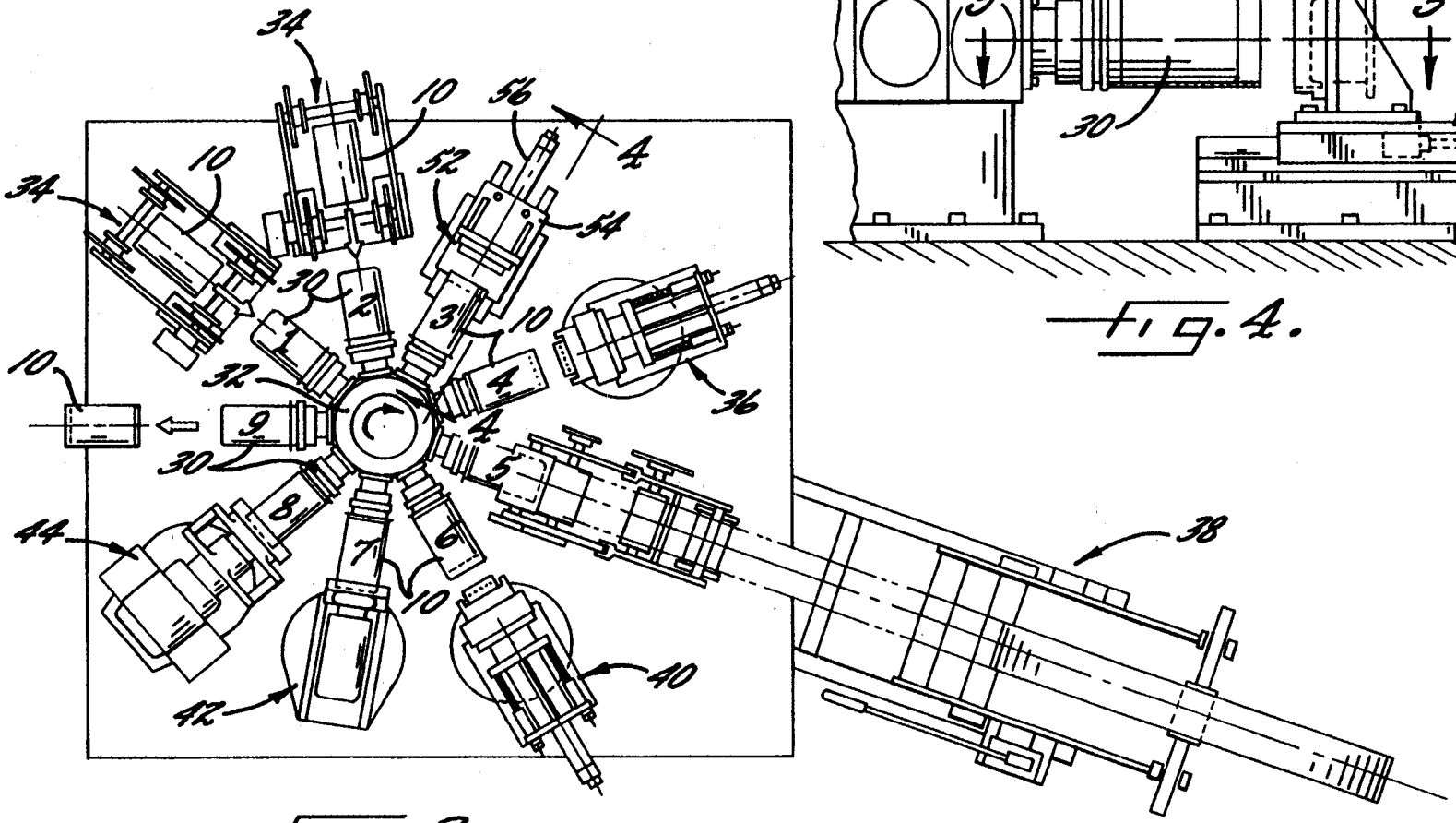
FIG. 3 is a schematic view of a turret-type forming apparatus including one preferred apparatus of the invention.

FIG. 3 illustrates in top view, a turret-type forming station which receives pre-cut cylindrical container bodies and which then performs various operations on the bodies for converting the bodies into containers. In accordance with the present invention, the turret apparatus shown in FIG. 3 is modified to include a lip forming apparatus.

In the form illustrated in FIG. 3, the apparatus includes a plurality of identical mandrels 30 which are rotated via a turret member 32 to move container bodies to various stations along the apparatus. As illustrated in FIG. 3, stations 1 and 2 receive container bodies 10 from a container body conveying apparatus 34. The cylindrical container bodies 10 are forced partially onto the empty mandrels 30 via the conveying and loading apparatus 34. A loaded mandrel from position 2 is then indexed to position 3. In a conventional operation, the container body is forced or tamped fully onto the mandrel at position 3 and thereafter the turret is indexed to position 4. Positions 4, 5, 6, 7 and 8 are conventionally used to insert a bottom closure member into the container body and to seal same into the container body. Typically, at position 4 a heating apparatus 36 contacts a portion of the interior periphery of the tube for preheating of same. The preheated container body is indexed to position 5 wherein a closure member supplied via conveying system 38 is inserted into the open bottom end of the container body. At position 6, the container bottom closure member is preheated by heating apparatus 40. At position 7 the lower portion of the container bodywall is folded inwardly by a folding apparatus 42 and bonded to the closure. At position 8, a finishing operation is conducted on the inwardly folded bottom of the container body by a finishing apparatus 44. At position 9, forced air from the interior of the mandrel 30 ejects the container body from the mandrel.

Figure 4:
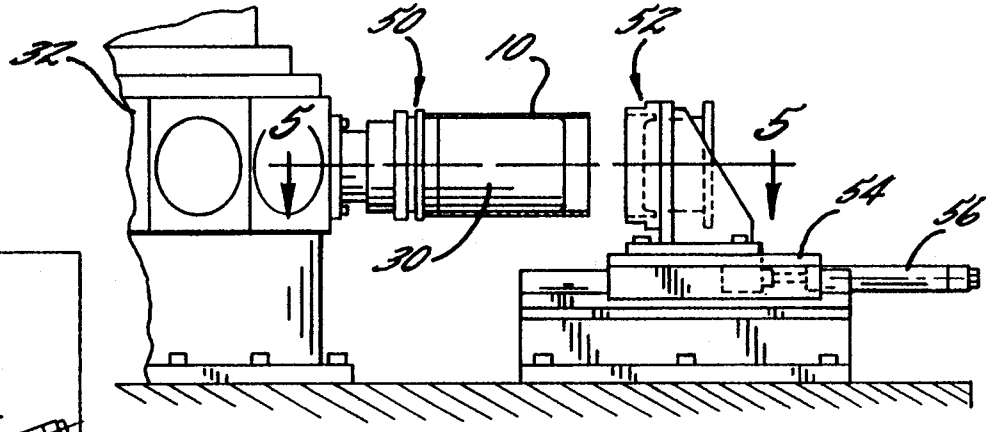
FIG. 4 illustrates a plan view of the preferred apparatus of the invention as incorporated into the turret-type forming apparatus.

FIG. 4 illustrates the lip forming apparatus of the invention as incorporated into station 3 of the turret forming apparatus shown in FIG. 3. The lip forming apparatus includes a mandrel body 30, a lip forming annular die 50 and an axial forcing member 52 for forcing the container bodies 10 radially inwardly along the mandrel body 30. The axial forcing member 52 is carried by a moveable support 54 and is moved inwardly and outwardly by a motor means, not shown, which is attached to the support 54 via rod 56.

Figure 5:
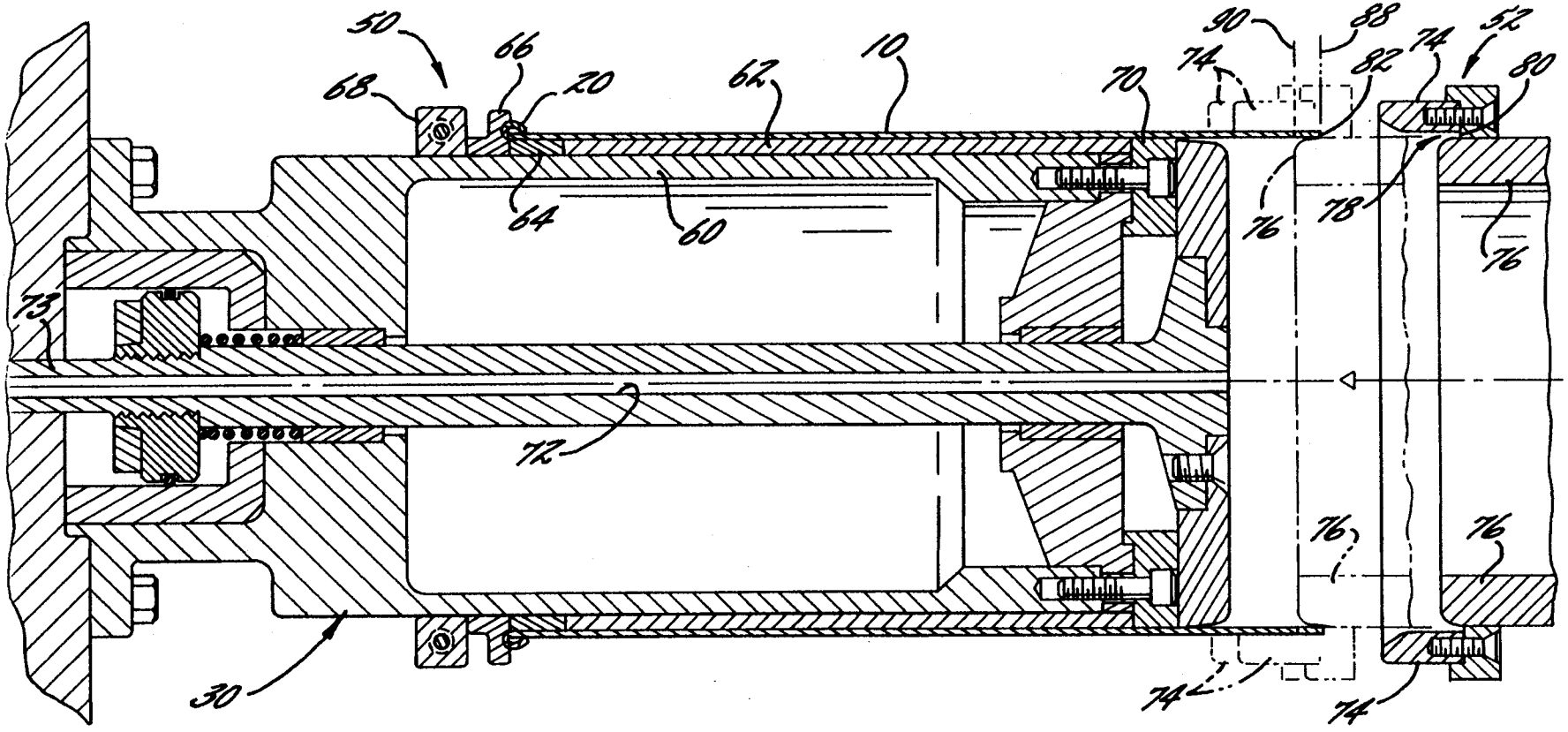
FIG. 5 is a cross sectional view taken along line 5—5 of FIG. 4 and illustrates a container body loaded onto one preferred apparatus of the invention, the container body being shown as having a curled rim formed in accordance with the invention.
Figure 6:
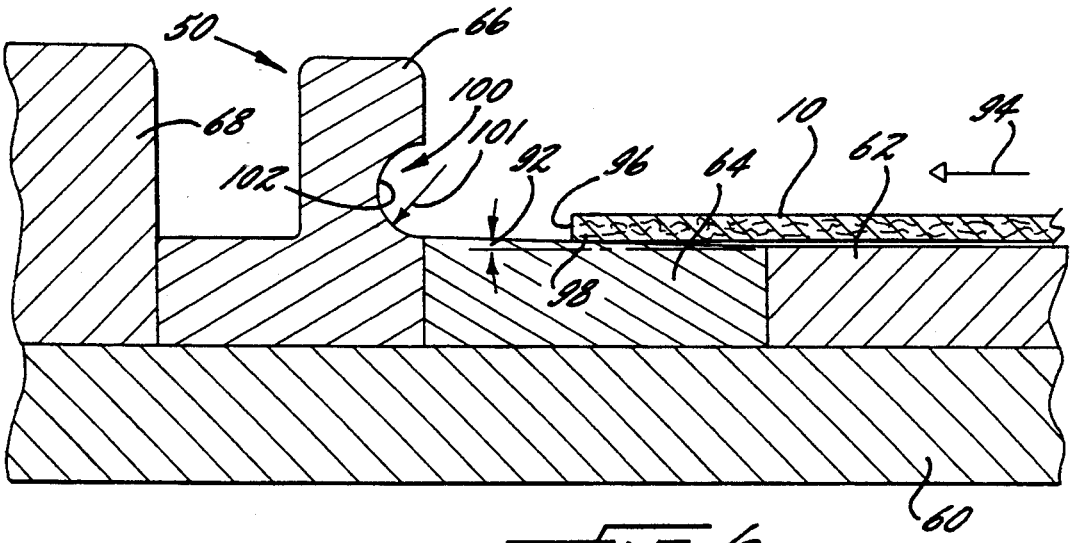
FIGS. 6, 7 and 8 are enlarged views of a portion of the apparatus shown in FIG. 5 with FIGS. 7 and 8 being enlarged to a greater extent than FIG. 6, and illustrate the stretching and rolling of the leading edge of the container body as it is forced axially along the mandrel constituting a portion of the apparatus of the invention.
Figure 7:
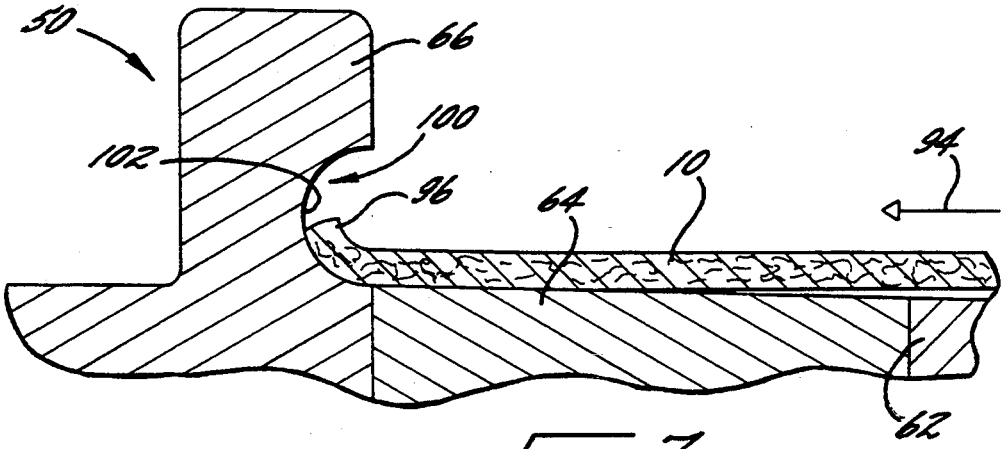
Figure 8:
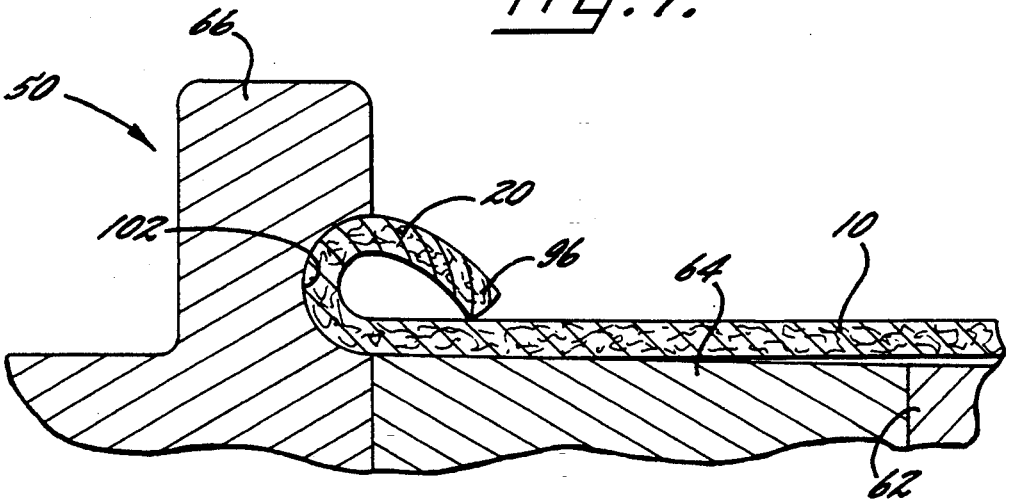

The apparatus of FIG. 4 is best seen in FIG. 5. With reference to FIG. 5, it can be seen that the mandrel 30 is formed from a mandrel body support 60, which supports a plurality of exterior sleeves 62, 64 and 66. Sleeve 62 has a true cylindrical exterior shape. Sleeve 64 is a frustoconical shaped sleeve which tapers radially and is best seen in FIGS. 6, 7 and 8, discussed in detail below. Sleeve 66 includes an annular lip forming die for forming folded rim 20 on container body 10. The outer surfaces of sleeves 62, 64 and 66 provide a substantially continuous and substantially smooth exterior compound surface to allow the container body to slide smoothly axially along the mandrel.

A moveable clamping member 68 is provided at the radially inward end of the mandrel body 30 and functions together with annular bottom member 70 for clamping the sleeve members 62, 64 and 66 to the exterior of the mandrel body member. The interior portion of the mandrel body includes an axially positioned bore 72 which receives pressurized air from an air inlet 73 and is used to eject container bodies from the mandrel at position 9 as discussed previously.

A preferred forcing means for forcing the container body 10 along the mandrel 30 is seen also in FIG. 5. The forcing means includes a short exterior cylindrical sleeve portion 74 which is sized to contact a portion of the exterior circumferential surface of the container body 10 adjacent the end thereof. An interior cylindrical sleeve 76 has an exterior circumference sized to support a portion of the interior circumferential surface of the container body 10 adjacent the end thereof. The space 78 formed between the exterior sleeve 74 and the interior sleeve 76 is of substantially the same thickness as the thickness of the body wall of the container body 10. In addition, at the lower end of the space 78 there is a bottom wall 80 which is sized and positioned to contact the bottom end face 82 of the container body 10.

Together, sleeves 74, 76 and bottom wall 80 of the forcing means cooperate to engage and support the end face and exterior and interior peripheral surfaces of the container body during the axial forcing operation. This in turn prevents or minimizes deformation of the container body end during the forcing operation. Engagement of the axial forcing member 52 with the container body member 10 is illustrated in phantom in FIG. 5. As seen by the phantom illustration, the bottom periphery of the container body 10 is supported about a portion of its circumferential exterior adjacent its end face by exterior sleeve member 74 and about a portion of its circumferential interior adjacent the end face 82 by the interior support member 76. In addition, the bottom wall 80 of space 78 is in surface to surface contact with end face 82 of the container body member 10.

As shown in phantom, the axial forcing member 52 moves axially inwardly to a position 88 wherein the end face 82 of the container body is engaged by the forcing member 52. Thereafter, the axial forcing member is moved axially toward the mandrel to a second position 90. This in turn, moves the container body 10 axially along the mandrel body thereby forming curled lip 20 on the upper edge of the container body. It will be recognized that the axial forcing means shown in FIG. 5 is a preferred embodiment of the invention and that other forcing means can be used in the present invention. Thus, flat, annular or differently configured forcing members which are designed and arranged to engage only the interior, exterior and/or the end face of the container body can also be advantageously used herein.

Formation of the curled lip is best illustrated in FIGS. 6, 7 and 8. Referring to FIG. 6, it is seen that segment or sleeve 64 tapers outwardly on an angle, 92, which can be up to 20°, preferably is between 0.5° and 10° and is more preferably between about 0.5° and about 5°, depending upon the length of the segment 64 and upon the diameter of the container body 10. Preferably, the length and degree of taper for segment 64 are such that the container body 10 is stretched outwardly, i.e., increased in diameter, in amount of between about 0.010 and about 0.030 in. as the container body 10 is forced along segment 64.

In general, the degree of taper and length of segment 64 will be at least sufficient to ensure an interference fit between the leading edge of container body and the exterior of the mandrel at the large diameter end of segment 64 adjacent the annular cavity 100. The interference fit or stretching is needed to even out the container body to ensure substantially equal radial pressure 360° around the perimeter of the container body as contact with annular cavity 100 is initiated. Additionally, as indicated previously the tapered segment 64 also functions as a deburring tool for the leading edge of the container body.

The degree of taper and length of the frustoconical segment 64 will thus vary depending on factors including the diameter and wall thickness of the container body. For example, the diameter of cylindrical segment 62 is typically chosen to be slightly less than the interior diameter of the container body to provide a good sliding fit of the container body on the cylindrical segment 62. Typically, a greater amount of clearance between the segment 62 and the container body is chosen for larger diameter container bodies. This in turn requires a somewhat increased degree of taper and/or length for the tapered segment 64 with larger diameter container bodies to ensure an interference fit at its larger end. Thus, the configuration of the segment 64 can be changed due to the fit between the container body and the segment 62 or to accommodate various other factors such as a change in the profile of annular cavity 100.

Returning to FIG. 6, the container body is moved in the direction shown by arrow 94 along segment 64, and the leading end 96 of the container bodywall is stretched outwardly. In addition, any container body burrs which were formed on the leading inside bodywall corner 98 during a previous cutting operation are substantially removed as the container body wall is forced along the axially outwardly tapering segment 64.

As also seen in FIG. 6, the annular lip forming cavity 100 includes a closed bottom portion 102 and an open mouth portion. The inside surface of the cavity is smooth to promote sliding of the container end along the contour thereof. The mouth of cavity 100 is oriented substantially transversely to the cylindrical mandrel body and faces generally in the direction of the cylindrical segment 62. For container bodies having a wall thickness of between about 0.020 and about 0.055 in., cavity 100 can have a radius 101 of between about 0.060 and about 0.095 in. For greater wall thicknesses, this radius can be increased. In addition the profile of cavity 100 can also be modified as will be apparent.

FIGS. 7 and 8 illustrate entry of the leading end 96 of the container body into annular cavity 100. As shown in FIG. 7, as the leading edge 96 of the container body is moved along the inside surface of the cavity, it is gradually turned radially outwardly. As shown in FIG. 8, the continued axial movement of container body 10 forces the leading edge 96 of the container body along the interior surface of cavity 100 and forces the edge to roll outwardly until the edge contacts the outer surface of the container bodywall, thereby forming the rolled lip 20. Thus, it will be appreciated that the rolled lip formation is accomplished in a single step by axially forcing the container body along a cylindrical mandrel, and along an outwardly tapering section thereof and finally into a semi-circular cavity. No separate rimming or flanging operation is required in order to form the rolled lip. Moreover because the rolled lip is contacted only with the smooth surface of interior cavity 100, the likelihood of formation of any surface defects on the lip is minimal The invention as illustrated herein is susceptible to numerous and various modifications and changes as will be readily apparent to the skilled artisan. For example, in the mandrel illustrated in FIGS. 4 and 5, the exterior shape and the cavity forming member are formed by three separate sleeve segments, 62, 64 and 66 which cooperate to form a substantially smooth and continuous exterior surface. This allows sleeves of smaller or greater outside diameter to be attached to a single mandrel core body 60. In addition, sleeves of different lengths can be employed for use with longer or shorter container bodies. However, it will be apparent that a single mandrel having the desired outside shape can be employed without the necessity for added sleeve members where desired. Similarly, only a single sleeve may be used for attachment to a mandrel core body. In such event, sleeve segments 62, 64 and 66 can be fabricated as a single unit. Alternatively, fewer or lesser segments may be employed to prepare the exterior mandrel shape illustrated in FIG. 5.

The mandrel shown in FIG. 5 includes various end face portions which are particularly useful for upstream apparatus to insert bottom closure members. It will be apparent that in the event a different mandrel system is used for inserting bottom closure members, a different mandrel end construction can be employed. Likewise, the central air supply bore 72 shown in FIG. 5 is an optional feature.

It will also be apparent that the apparatus of the invention can be employed in constructions other than the radial container forming apparatus shown in FIG. 3. Thus, a multiple station container forming apparatus wherein a plurality of mandrels are linearally arranged can also incorporate the apparatus of the invention. Still further, the apparatus of the invention can be employed as a stand-alone apparatus when container bottom closure members are integrally incorporated into a container body or are incorporated therein in a separate operation.

The invention is particularly useful for paperboard spirally wound container bodies of relatively large wall thickness as has been described in detail previously. However, it will be apparent that the apparatus and process of the invention can also advantageously be used in connection with other deformable container bodies including bodies formed of plastic material and the like. Similarly, the apparatus is considered particularly advantageous for paperboard bodies formed by convolute winding processes and the like.

The invention has been described in considerable detail with reference to its preferred embodiment. However, it will be apparent that numerous modifications and variations can be made within the spirit and teachings of the inventions as described in the foregoing detailed specification and defined in the appended claims.

That which is claimed is:

1. An apparatus for forming an outwardly rolled lip on a deformable cylindrical container body having an open end and a second end comprising:

a mandrel having a cylindrically shaped portion for supporting at least a portion of the interior of the deformable cylindrical container body;

a lip-forming die having an annular cavity positioned coaxially with and axially spaced from the cylindrical portion of the mandrel, the annular cavity having a generally semi-circular cross section and, including an open mouth and a closed bottom extending radially outwardly of the mandrel and being oriented with the open mouth generally transverse to the axis of the mandrel and in a direction facing the cylindrically shaped portion of the mandrel;

said mandrel having a frusto-conically shaped portion positioned between said cylindrical portion and said lip forming die, the frusto-conically shaped portion tapering radially outwardly in the direction from the cylindrical portion of the mandrel toward the lip forming die;

said cylindrically shaped portion of the mandrel, said frusto-conically shaped portion of said mandrel and said lip forming die, forming portions of a substantially smooth and substantially continuous exterior compound surface to allow said deformable container body to slide smoothly axially along the mandrel.

2. The apparatus of claim 1 wherein said radially tapered portion of said mandrel is tapered in an amount of up to about 20 degrees.

3. The apparatus of claim 1 wherein said radially tapered portion of said mandrel is tapered in an amount of between about 1 and about 5 degrees.

4. The apparatus of claim 1 additionally comprising an axial forcing means for forcing the cylindrical container body in the direction from said first cylindrical portion of the mandrel towards said second radially tapered portion of said mandrel.

5. The apparatus of claim 4 wherein said axial forcing means comprises a means for engaging the second end of said container body at its end face and about a portion of its exterior and interior peripheral surfaces adjacent to said end face.

6. The apparatus of claim 1 wherein said mandrel comprises a mandrel body support and at least one peripheral exterior sleeve mounted on said mandrel body support and defining said first and said second portions of said mandrel and said lip forming dye.

7. The apparatus of claim 6 comprising a plurality of sleeves mounted on said mandrel body support and defining said first portion and second portion of said mandrel and said lip-forming die.

8. The apparatus of claim 1 wherein said second radially tapered portion of said mandrel has a length and a taper sufficient to increase the exterior circumference of said radially tapered portion in an amount of between about 0.010 and about 0.030 in.

9. The apparatus of claim 1 wherein said mandrel is mounted on a rotatable turret.

10. An apparatus for forming containers from a plurality of container bodies, each having an open end and a second end comprising a plurality of radially oriented forming mandrels mounted on a rotatable turret, each of said mandrels comprising:

a cylindrical shaped portion for supporting the interior of one of the cylindrical container bodies; and a lip forming die having annular cavity positioned coaxially with and axially spaced from the cylindrical portion of the mandrel, the annular cavity having a generally semi-circular cross-section and including an open mouth and a closed bottom extending radially outwardly of the mandrel and being oriented with the open mouth generally transverse to the axis of the mandrel and in a direction facing the cylindrically shaped portion of the mandrel; and a frusto-conically shaped portion positioned between said cylindrical portion and said lip forming die, the frusto-conically shaped portion tapering radially outwardly in the direction from the cylindrical portion of the mandrel towards the lip forming die;

said cylindrical shaped portion of the mandrel, said frusto-conically shaped portion of said mandrel and said lip forming die, forming portions of a substantially smooth and substantially continuous exterior compound surface to allow said deformable container body to slide smoothly axially along the mandrel.

11. The apparatus of claim 10 wherein said turret is indexed for rotation of said mandrels to a plurality of stations for performing a plurality of predetermined operations on said container body.

12. The apparatus of claim 11 wherein a predetermined one of said stations comprises an axial forcing means for forcing the cylindrical container body axially along a mandrel positioned at said predetermined station.

13. The apparatus of claim 12 wherein said axial forcing means comprises a means for engaging the second end of said container body about the end face, and a portion of the both the exterior and interior peripheral surfaces adjacent said end face of said container body.

14. The apparatus of claim 13 wherein said second radially tapered portion of said mandrel tapers in an amount of up to about 20°.

15. The apparatus of claim 13 wherein said second radially tapered portion of said mandrel tapers in an amount of between about 1 and about 5 degrees.

16. The process for forming an outwardly rolled lip on a cylindrical container body of predetermined diameter having at least one open end and a second end, the process comprising;

placing said open end of said cylindrical container body coaxially on a cylindrical portion of a mandrel having substantially the same outside diameter as the inside diameter of the cylindrical container body;

forcing said open end of said container body axially along said cylindrical portion of said mandrel and axially along a frusto-conically shaped portion of said mandrel to thereby outwardly stretch the open end of said container body; and forcing said stretched open end of said container body into an annular cavity of generally semi-circular cross-section having an open mouth and closed bottom extending radially outwardly of the mandrel, and being oriented with the open mouth generally transverse to the axis of the mandrel and in a direction facing the cylindrical shaped portion of the mandrel, to thereby cause said stretched open end of said container body to roll outwardly to form said outwardly rolled lip on said container body;

said cylindrical portion of said mandrel, said frusto-conically shaped outwardly tapering portion of said mandrel and said annular cavity, forming portions of a substantially smooth and substantially continuous exterior compound surface whereby said forcing steps of said lip forming process are conducted as said container body slides axially along the mandrel.

17. The process of claim 16 wherein said cylindrical container body comprises at least one paperboard layer and has a wall thickness greater than about 0.015 inch.

18. The process of claim 17 wherein said cylindrical container body additionally comprises an interior film or film/foil layer.

19. The process of claim 17 wherein said cylindrical container body is a spirally wound container body.

20. The process of claim 19 wherein said container body has a wall thickness greater than about 0.02 inch.

21. The process of claim 17 additionally including the step of supporting the second end of said container body about at least a portion of its end face and its exterior and interior peripheral surfaces adjacent said end face during said step of forcing the container body along said mandrel.

22. The process of claim 17 wherein said second axially tapering portion of said mandrel is tapered in an amount sufficient to stretch the diameter of said open mouth of said container body in an amount of about between about 0.010 and about 0.030 in.

23. The process of claim 17 wherein said container body comprises a cylindrical burr on the inside periphery of said open end.

24. The process of claim 17 wherein said container body is a convolute wound container body.

25. The process of claim 16 wherein said container body is formed of a plastic material.

* * * * *

UNITED STATES PATENT AND TRADEMARK OFFICE

CERTIFICATE OF CORRECTION

PATENT NO. : 5,431,619

DATED : July 11, 1995

INVENTOR(S) : Bacon et al.

It is certified that error appears in the above-identified patent and that said Letters Patent is hereby corrected as shown below:

Col. 8, line 33, omit the comma (,) at the end of the line.

Col. 9, line 5, "dye" should be --die--.

Col. 9, line 25, before "annular" insert -- an--.

Col. 9, line 61, omit "the" (first occurrence).

Col. 10, line 7, the semicolon (;) should be a colon (:).

Col. 10, line 56, omit "about".

Signed and Sealed this

Twenty-fourth Day of September, 1996

*Attest:*

*Attesting Officer*

Bruce Lehman

BRUCE LEHMAN

*Commissioner of Patents and Trademarks*